US005240044A

United States Patent [19]

Arnold

[11] Patent Number: 5,240,044

[45] Date of Patent: Aug. 31, 1993

[54] WORK PIECE CARRIER WITH AUXILIARY CARRIER FOR PRODUCING ELECTRIC COILS

[75] Inventor: Ernst Arnold, Buchs, Switzerland

[73] Assignee: Meteor AG, Ruschlikon, Switzerland

[21] Appl. No.: 933,082

[22] Filed: Aug. 21, 1992

[30] Foreign Application Priority Data

Aug. 29, 1991 [CH] Switzerland ..... 02540/91

[51] Int. Cl.[5] ..... B21F 3/04

[52] U.S. Cl. ..... 140/92.1; 242/7.09

[58] Field of Search ..... 140/92.1, 92.2; 242/7.09, 25 A, 35.5 A

[56] References Cited

U.S. PATENT DOCUMENTS 3,314,452 4/1967 Cartwright et al. .
3,698,652 10/1972 Morikawa et al. .
4,558,835 12/1985 Sunaoka ..... 140/92.1
4,817,888 4/1989 Arnold .

FOREIGN PATENT DOCUMENTS

3049407A1 7/1982 Fed. Rep. of Germany .

*Primary Examiner*—Lowell A. Larson
*Attorney, Agent, or Firm*—Burns, Doane, Swecker & Mathis

[57] ABSTRACT

A work piece carrier which has a base plate adapted for frictionally engaging a conveyor belt is disclosed. At least two semicircular supports, open at the top, are rigidly connected with the base and are disposed at a distance to each other. A retaining pin for coil wire remnants is disposed between the two supports of the work piece carrier. A removable auxiliary carrier with a coil body is seated in or removed from each support crosswise to the longitudinal extension of the conveyor belt, where a cylindrical body of the auxiliary carrier has at least one, preferably two auxiliary retaining pins for coil wire ends. In one embodiment, reversing pins are axially disposed at a distance from each auxiliary retaining pin on the cylindrical body of the auxiliary carrier for forming loops of the coil wire. In this way the length of the wire end sections can be varied, for example for subsequent manually performed finishing of the completed coil.

7 Claims, 3 Drawing Sheets

WORK PIECE CARRIER WITH AUXILIARY CARRIER FOR PRODUCING ELECTRIC COILS

FIELD OF THE INVENTION

The present invention relates to a work piece carrier for the automatic production of electrical coils.

BACKGROUND OF THE INVENTION

Work piece carriers for a multiple-spindle coiling machine are disclosed in German Patent No. 35 31 730 (U.S. Pat. No. 4,817,888). The work piece carriers are conducted by means of a conveyor belt along the individual coiling stations and other processing stations of the multiple-spindle coiling machine, and are stopped and released again at the respective coiling stations and processing stations by catches which can be moved into and out of the direction of movement of the work pieces. Each work piece carrier consists of a base plate that frictionally engages the conveyor belt, where at least two supports for the coil bodies are rigidly connected with the latter and disposed at a distance from each other. A retaining pin for coil wire remnants is disposed between the two supports. Guide rails for the base plate of the work piece carrier are disposed in a lifting device laterally of the conveyor belt in the individual coiling stations and processing stations in such a way that the work piece carriers can be lifted off the conveyor belt and again lowered on it, and that a wire guide having a cutting device associated with it is provided on a pivot arm for each coiling station. The two supports disposed on the work piece carrier make it possible to take up a already wound coil body from the coiling station by placing it on a free support of the work piece carrier and, at the same time, to transfer an unwound coil body present in a second support to the coiling station by displacing the work piece carrier by one half of a coiling station division, for example. Controlled retention and removal of the coil wire remnant is performed by means of the retaining pin disposed on the work piece carrier.

OBJECT AND SUMMARY OF THE INVENTION

Based on the above state of the art, it is the object of the invention to provide a particularly practical embodiment of the work piece carrier, so that the work piece carrier can be employed in connection with the automatic production of electrical coils. In particular, in the prior machine, a plurality of coiling stations and further processing stations are located upstream and downstream of them, and that a so-called chaotic production is possible, independently of the electrical coil to be produced, where the coil bodies can be embodied with and/or without connecting elements. At the same time, it is intended to assure that it is possible to employ uniform tools with suitable tool receptacles for the coil bodies to be processed at all coiling stations and processing stations and that the length of the wire ends can be varied.

This object is attained by means of a work piece carrier having a base plate adapted for frictionally engaging a conveyor belt. The carrier has at least two semicircular supports, open at the top, rigidly connected with the latter and disposed at a distance from each other. A retaining pin for coil wire remnants is disposed between the two supports of the work piece carrier, and the work piece carriers are embodied to be lifted from the conveyor belt and lowered in at least one coiling station and in upstream and downstream processing stations.

By means of the employment of the auxiliary carrier of the invention, which can be placed on the work piece carrier, and which respectively receives a coil body on a correspondingly embodied coil body receptacle and has at least one auxiliary retaining pin, the coil body remains on the auxiliary carrier during the entire course of processing. The auxiliary carrier has uniform tool receptacles on its front which fit into the tools of the coiling stations and other processing stations. This avoids the time-wasting re-tooling of the processing device even when different series of types of coil bodies, so-called coil families, are to be processed at the same time.

The auxiliary retaining pins for the wire remnants disposed on the auxiliary carrier allow the formation of the wire end section in accordance with requirements, for example in the form of loops in case of coil bodies without connecting elements, if particularly long wire ends are required, preferably for the subsequent finishing of the completed coils, which as a rule is performed manually.

Because the repeated direct transfer of the coil bodies to the coiling station or to further processing stations and back again, which up to now was repeatedly required, can be omitted, exact and smooth processing and avoidance of sources for errors is assured by the controlled support of the coil body in the auxiliary carrier.

Because the wire ends are fastened on auxiliary retaining pins and are simultaneously positioned in the area of the connecting pins, their connection with the connecting pins, for example by soldering, can take place later outside of the coiling station, which often is an advantage.

DESCRIPTION OF THE DRAWINGS

Exemplary embodiments of apparatus in accordance with the invention are shown in the drawings, in which.

DETAILED DESCRIPTION

Figure 1:
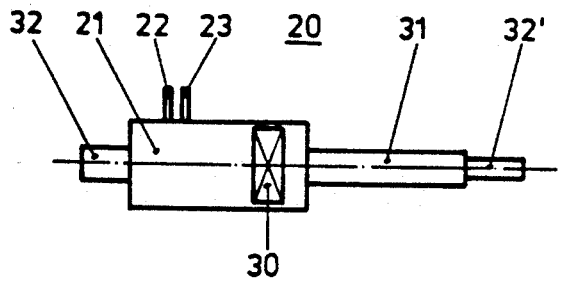
FIG. 1 is a side elevational view of an auxiliary carrier in accordance with the invention.
Figure 2:
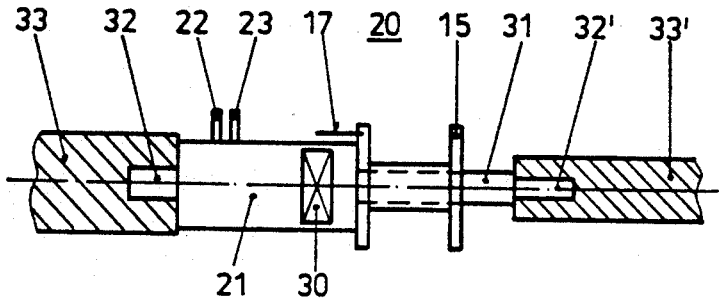
FIG. 2 is a side elevational view, partially in section, of the auxiliary carrier of FIG. 1 with an unwound coil body.
Figure 3:
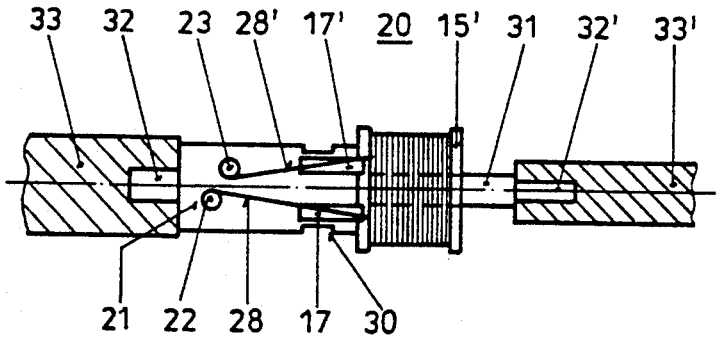
FIG. 3 is a top plan view of the auxiliary carrier of FIGS. 1 and 2, with a wound coil body and auxiliary retaining pins for coil wire ends.
Figure 4:
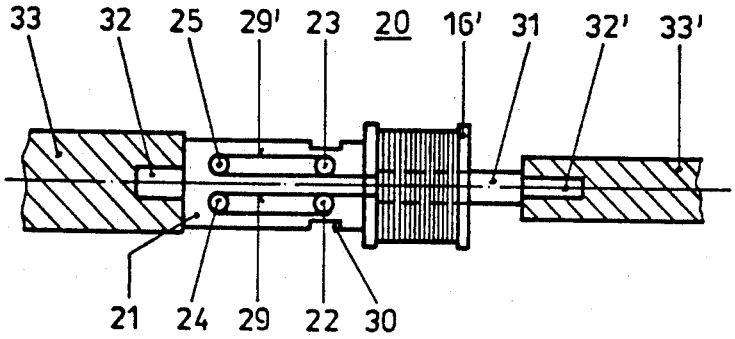
FIG. 4 is a top plan view of the auxiliary carrier as in FIG. 3 with additional reversing pins for coil wire ends embodied as loops.

As shown in FIGS. 1 to 4, an auxiliary carrier 20 includes a cylindrical body 21, on which auxiliary retaining pins 22, 23 are disposed. The axial extension of the cylindrical body 21 forms a coil body receptacle 31. On the side opposite the coil body receptacle 31, the cylindrical body 21 has a first tool bearing 32, and on the other face of the coil body receptacle 31 it has an extension on the front received in a second tool socket 32'. The tool bearings 32, 32' are identically embodied in all auxiliary carriers 20 and fit the tools 33, 33' of the coiling stations and processing stations, not shown, as shown in FIGS. 2 to 4. An unwound coil body with connecting elements 17, 17' has been placed on the coil body receptacle 31 in FIG. 2 and is maintained in a tool 33 by means of the tool bearing 32'.

A coil body 15', as shown in FIG. 3, has connecting elements 17, 17' and extended coil wire ends 28, 28', which are wound directly on auxiliary retaining pins 22, 23. Referring to FIG. 4, a wound coil body 16' without connecting elements has extremely long wire ends 29, 29'. Reversing pins 24, 25 are spaced from the auxiliary retaining pins 22, 23 and the wire ends 29, 29' are wound as loops around the pairs of pins 23, 25 and 22, 24.

Figure 5:
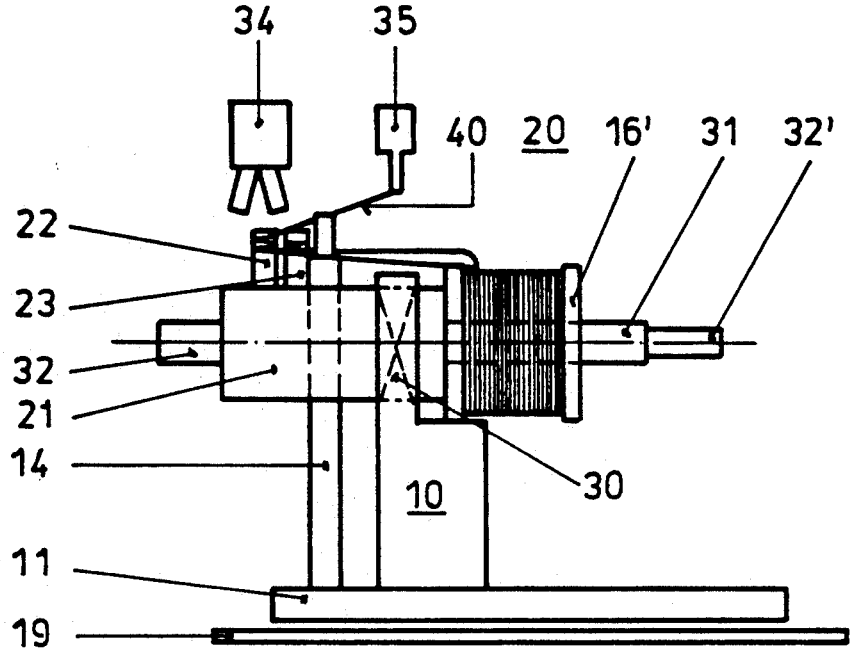
FIG. 5 is a side elevational view of a work piece carrier with an auxiliary carrier and a wire guide and with a cutting device for the coil wire.
Figure 6:
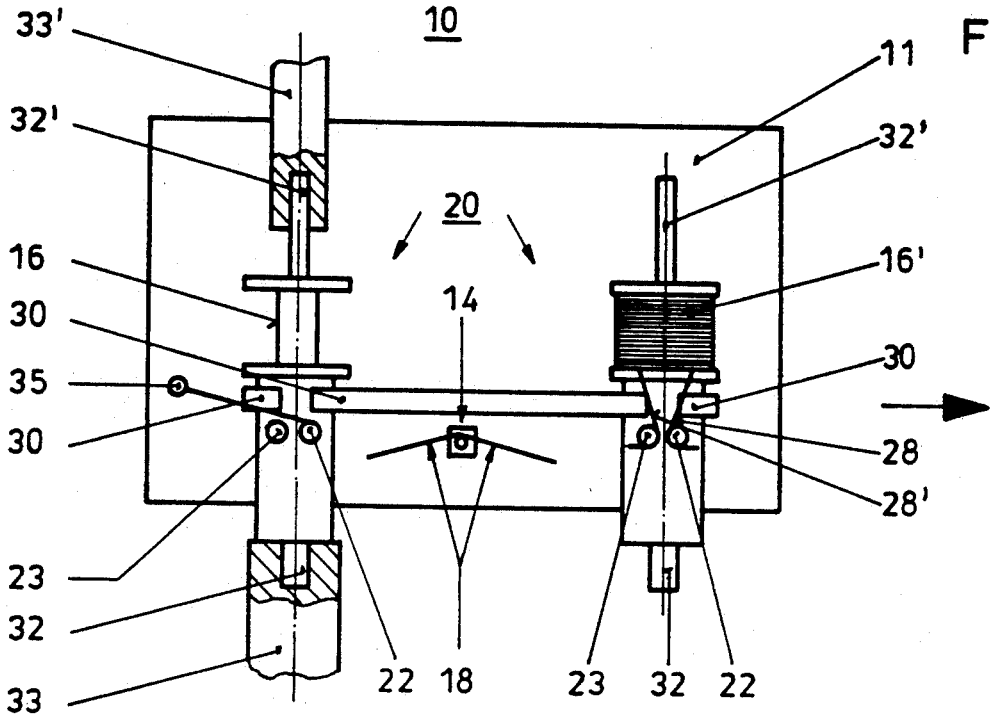
FIG. 6 is a top plan view of the work piece carrier with auxiliary carriers, as in FIG. 5.
Figure 7:
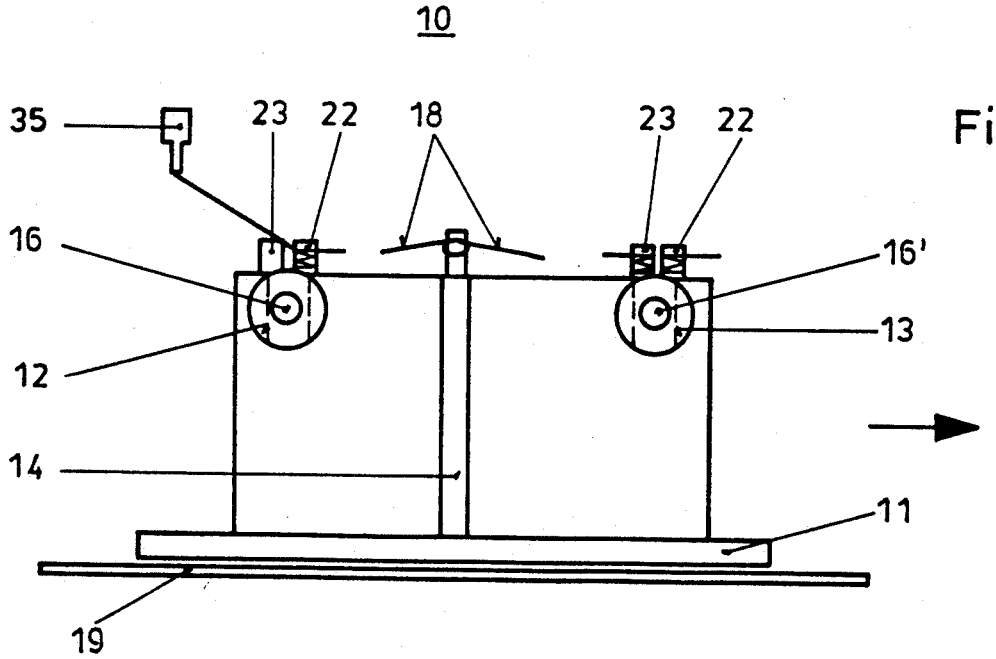
FIG. 7 is a side elevational view of the work piece carrier with auxiliary carriers as in FIG. 6.

In FIGS. 5, 6 and 7, the auxiliary carriers 20 in accordance with the invention are shown mounted on the the work piece carriers 10. Each work piece carrier 10 consists of a base plate 11 with two semicircular supports 12, 13, open at the top, rigidly disposed at a distance from each other, and with a retaining pin 14 disposed between them, which is used for receiving the coil wire remnants 18. Instead of inserting the coil bodies 15, 15' or 16, 16' directly into the supports 12, 13 of the work piece carrier 10, as was previously done, the auxiliary carrier 20, together with the coil body 15, 15' or 16, 16' already placed on the coil body receptacle 31, is inserted into one of the two supports 12, 13 or taken from it. The auxiliary carrier 20, 20' preferably has flattened places used as guide faces 30, for inserting it into the work piece carrier 10 in a manner secure from turning.

In accordance with FIGS. 5, 6 and 7, two auxiliary carriers 20 with coil bodies 16, 16' not having connecting elements 17, 17', have been inserted in the supports 12, 13 of the work piece carrier 10, where in the direction of conveyance (direction of the arrow at the right in FIGS. 6 and 7) the first coil body 16', already wound at the coiling station, was inserted into the support 13 while the second coil body 16, inserted into the support 12, is ready for transfer into the coiling station, together with the auxiliary carrier 20. Before the auxiliary carrier 20 with the coil body 16 can be transferred (FIG. 5) into the coiling station, the beginning of the wire was already inserted as the wire end 28 into the auxiliary retaining pin 22 through a wire guide 35 and a cutting device 34 and cut to the required length. Following the end of the coiling process, the wire end 28' is inserted into the auxiliary retaining pin 23 and the auxiliary support 20 with the wound coil body 16' is inserted into the first support 13 of the work piece carrier 10, in which case the coil wire 40 is wound around the retaining pin 14 of the work piece carrier 10 with the aid of the wire guide 35. Subsequently, the wire is brought to the second, unwound coil body 16 and is inserted into the retaining pin 22 of the auxiliary carrier 20 to form the beginning of the wire and is subsequently cut.

In case extremely long wire ends are required for the subsequent finishing of the completed coils, which is performed manually as a rule, the wire ends are embodied as loops 29, 29', analogously to FIG. 4, in that reversing pins 24, 25 are disposed at a distance from each auxiliary retaining pin 22, 23 on the cylindrical body of the auxiliary carrier 20 and around which reversing pins the wire is wound several times, depending on the required length of the wire ends.

Figure 8:
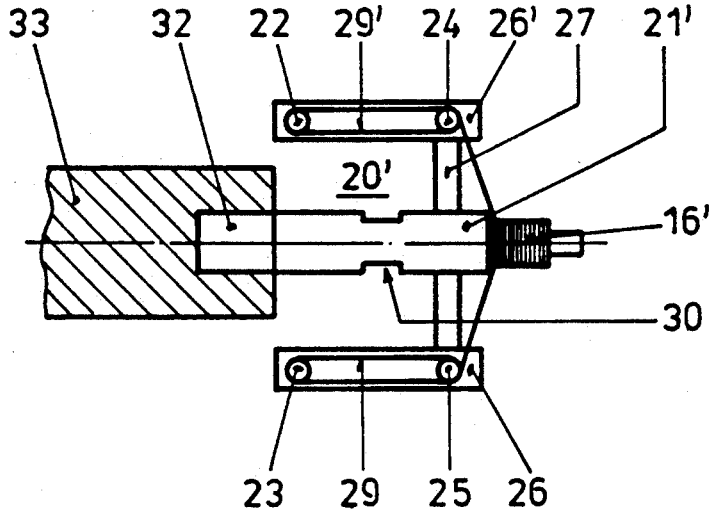
FIG. 8 is a side elevational view of a modified form of the auxiliary carrier.

Another embodiment of the auxiliary support 20' is shown in FIG. 8. The cylindrical body 21, which has a tool receptacle 32 on only one end, fits overhung into the corresponding tool 33 of each coiling station or further processing stations. The disposition of the auxiliary retaining pins 22, 23 and of the reversing pins 24, 25 is provided on both sides at a distance from the cylindrical body 21' of the auxiliary carrier 20' on parallel extending rails 26, 26', which are supported by a cross brace 27 disposed on the auxiliary carrier 20'. The retaining pins 22, 23 and reversing pins 24, 25 are used, in an analogous manner to FIG. 4, to secure the wire ends of the miniature coil body 16', made of variable length in the form of loops 29, 29'.

While this invention has been illustrated and described in accordance with a preferred embodiment, it is recognized that variations and changes may be made therein without departing from the invention as set forth in the claims.

What is claimed is:

1. A work piece carrier for the production of electrical coils comprising: a base plate for frictionally engaging a conveyor belt, at least two supports on said base plate spaced apart from each other; an auxiliary carrier having a coil body receptacle for receiving a coil body, mounting means for removably mounting said auxiliary carrier on one of said supports, said work piece carrier having at least one auxiliary retaining pin for receiving coil wire ends, whereby when the auxiliary carrier is mounted on the support, and a coil body is positioned on said receptacle, coil wire ends from the coil body may be wound on said pin.

2. A work piece carrier in accordance with claim 1, wherein said auxiliary carrier has a cylindrical body portion, guide means for preventing rotation of the auxiliary carrier relative to the work piece carrier, said carrier having a tool bearing at the end of the auxiliary carrier that is opposite said receptacle, and said pin being located between said receptacle and said tool bearing.

3. A work piece carrier in accordance with claim 1, wherein said auxiliary carrier has a cylindrical body portion adjacent to said coil body receptacle, said work piece carrier having a pair of rails spaced on opposite sides of said cylindrical body portion, said work piece carrier having a plurality of auxiliary retaining pins for receiving coil wire ends, said pins being mounted on said rails.

4. The work piece carrier in accordance with claim 1, wherein said at least one auxiliary retaining pin includes a plurality of retaining pins, said pins being arranged in one or more pairs of pins for receiving coil wire ends looped around said pair of pins.

5. The work piece carrier in accordance with claim 4, wherein said retaining pins project upwardly from said workpiece carrier base when said auxiliary carrier is mounted in one of said supports.

6. The work piece carrier in accordance with claim 4, wherein the spacing between adjacent auxiliary retaining pins is predetermined to correspond to the length of coil wire to be wound on said pins.

7. The work piece carrier in accordance with claim 1, wherein said auxiliary carrier has shaft bearings at opposite ends to be received in tool sockets, said shaft bearings being aligned along an axis to provide for rotation about said axis.

* * * * *